US005842636A

United States Patent [19]

Moroi et al.

[11] Patent Number: 5,842,636

[45] Date of Patent: Dec. 1, 1998

[54] VISCOUS FLUID TYPE HEAT GENERATOR

[75] Inventors: Takahiro Moroi; Kenji Takenaka; Takashi Ban; Shigeru Suzuki, all of Kariya, Japan

[73] Assignee: Kabushikki Kaisha Toyoda Jidoshokki Seisakusho, Kariya, Japan

[21] Appl. No.: 963,019

[22] Filed: Nov. 3, 1997

[30] Foreign Application Priority Data

Nov. 6, 1996 [JP] Japan ..... 8-293832

[51] Int. Cl.[6] ..... B60H 1/02

[52] U.S. Cl. ..... 237/12.3 R; 237/12.3 B; 122/26; 126/247

[58] Field of Search ..... 237/12.3 R, 12.3 B; 122/26; 126/247

[56] References Cited

U.S. PATENT DOCUMENTS

| | | | |
|---|---|---|---|
| 4,285,329 | 8/1981 | Moline | 126/247 |
| 4,312,322 | 1/1982 | Freihage . | |
| 4,974,778 | 12/1990 | Bertling . | |
| 5,573,184 | 11/1996 | Martin . | |

FOREIGN PATENT DOCUMENTS

| | | |
|---|---|---|
| A2246823 | 10/1990 | Japan . |
| A976731 | 3/1997 | Japan . |

*Primary Examiner*—Henry H. Bennett
*Assistant Examiner*—Derek S. Boles
*Attorney, Agent, or Firm*—Burgess, Ryan & Wayne

[57] ABSTRACT

The viscous type heat generator includes a housing having a heating chamber and a heat radiating chamber. A rotor is rotatably arranged in the heating chamber so that a viscous fluid is subjected to a shearing action to generate heat. The rotor is fitted on a drive shaft in such a manner that the rotor can not rotate but can move axially relative to the drive shaft. The front and rear end surfaces of the rotor have wedge effect producing means for correcting an axial offset of the rotor in the heating chamber by the wedge effect caused by the pressure of viscous fluid while the rotor is rotating. This wedge effect producing means comprises at least three inclined recesses extending in the circumferential direction, the bottoms of which become gradually shallower in the direction opposite to the rotational direction of the rotor. The inclined recesses are arranged at circumferentially regular intervals and at radially equal positions from the center of the rotor.

7 Claims, 6 Drawing Sheets

VISCOUS FLUID TYPE HEAT GENERATOR

BACKGROUND OF THE INVENTION

1. Field of the Invention

The present invention relates to a viscous fluid type heat generator in which viscous fluid is heated by a shearing action thereof and the heat generated by the shearing action is transmitted to a circulating fluid circulating through a heat radiating chamber to utilize as a source of heating.

2. Description of the Related Art

A viscous fluid type heat generator applied to a vehicle heater is disclosed in Japanese Unexamined Patent Publication No. 2-246823. This viscous fluid type heat generator is arranged in such a manner that a front housing and a rear housing are opposed to each other and fastened by through-bolts, so that a heating chamber is formed in the housings and a water jacket is formed outside the heating chamber. In the water jacket, circulating water is circulated in such a manner that it is taken into the water jacket via an inlet port and delivered to an external heating circuit via an outlet port. In the front housing, a drive shaft is rotatably supported by a bearing device, and a rotor is fixed to the drive shaft so that the rotor can be rotated in the heating chamber. Labyrinth grooves are provided on front and rear end surfaces of the rotor at the circumferential portions thereof, and on the wall surfaces of the heating chamber, close to each other. Both labyrinth grooves are engaged with each other with a small clearance (referred to as a liquid-tight clearance) between them. Viscous fluid such as silicon oil contained in the heating chamber is interposed in these liquid-tight clearances.

In this viscous fluid type heat generator incorporated into the heating unit of a vehicle, the drive shaft is driven by the engine, and the rotor is rotated in the heating chamber, so the viscous fluid contained in the heating chamber and interposed in the liquid-tight clearance is heated by the shearing action thereof. The heat generated by the shearing action is heat-exchanged with the circulating water in the water jacket. Accordingly, heated circulating water is fed to the heating circuit of the vehicle for air conditioning the vehicle.

However, it has been found, in the above viscous fluid type heat generator of the prior art, that when the heat generator is improved to increase a quantity of heat generated per one revolution of the rotor, the outer surfaces of the rotor tend to interfere with the wall surfaces of the heating chamber.

That is, since the tolerance is allowed in the manufacturing process, it is difficult to assure perfectly accurate axial dimensions of the drive shaft and the heating chamber. Accordingly, since the rotor is fixed to the drive shaft in the viscous fluid type heat generator of the prior art, the rotor is rotated in the operation of the viscous fluid type heat generator while the difference between the axial dimensions of the rotor and the heating chamber is maintained, resulting that the outer surfaces of the rotor tend to interfere with the wall surfaces of the heating chamber. When the liquid-tight clearance between the wall surface of the heating chamber and the outer surfaces of the rotor is extended so as to avoid such an interference, the shearing action of the viscous fluid is reduced, so a quantity of heat generated per one revolution of the rotor is decreased.

In order to solve the above problems, the applicant(s) for the present case proposed and filed a patent application (Japanese Patent Application No. 7-232691). According to this patent application, in order to prevent the interference between the outer surfaces of the rotor and the wall surfaces of the heating chamber while a quantity of heat generated in one revolution of the rotor is maintained sufficiently, there is provided a viscous fluid type heat generator in which the rotor is combined to the drive shaft in such a manner that the rotor cannot rotate relative to the drive shaft but that the rotor can move axially.

However, in the viscous fluid type heat generator of the above patent application, the rotor is axially movably combined to the drive shaft, so the rotor is offset in the heating chamber, resulting that the viscous fluid is not uniformly distributed in the heating chamber, the quantity of generated heat is decreased, and further the viscous fluid tends to be deteriorated.

SUMMARY OF THE INVENTION

The present invention has been accomplished in view of the above circumstances, and the object of the present invention is to provide a viscous fluid type heat generator in which a quantity of heat generated per one revolution of the rotor is maintained large, any interference between the outer surfaces of the rotor and the wall surfaces of the heating chamber is avoided, and any axial offset of the rotor is suppressed to prevent the decrease in the generated heat and deterioration of the viscous fluid caused by the uneven distribution of viscous fluid.

The viscous fluid type heat generator according to the present invention comprises: a housing having therein a heating chamber and a heat radiating chamber arranged adjacent to the heating chamber for circulating a circulating fluid through said heat radiating chamber, said heating chamber having opposite wall surfaces; a drive shaft rotatably supported by the housing; a rotor rotatably arranged in the heating chamber and driven by the drive shaft, said rotor having front and rear end surfaces, liquid-tight clearances being formed between the front and rear end surfaces of the rotor and the wall surfaces of the heating chamber; and a viscous fluid contained in the heating chamber, the viscous fluid existing in the liquid-tight clearances so as to be heated during the rotation of the rotor. The rotor is fitted on the drive shaft in such a manner that the rotor cannot rotate relative to the drive shaft but can move axially relative to the drive shaft, and the front and rear end surfaces of the rotor have wedge effect producing means, respectively, for correcting an axial offset of the rotor in the heating chamber by a wedge effect caused via the pressure of the viscous fluid during the rotation of the rotor.

In this viscous fluid type heat generator, since the rotor is fitted on the drive shaft in such a manner that the rotor can not rotate relative to the drive shaft, when the drive shaft is rotated, the rotor is rotated in the heating chamber, heat is. generated by the shearing action of viscous fluid in the liquid-tight clearance, and heating can be performed by the thus generated heat.

In this viscous fluid type heat generator, even if there is a difference between the dimension of the rotor and the dimension of the heating chamber due to the tolerance allowed in the manufacturing process, the difference of the dimensions can be absorbed by the fact that the rotor is axially moveable relative to the drive shaft.

Therefore, in this viscous fluid type heat generator, even if the liquid-tight clearance between the wall surface of the heating chamber and the outer surface of the rotor is decreased to some extent so as to increase a quantity of heat generated per one revolution of the rotor, no interference occurs between the outer surface of the rotor and the wall surface of the heating chamber.

Further, in this viscous fluid type heat generator, an axial offset of the rotor in the heating chamber can be corrected, due to the wedge effect caused by the pressure of viscous fluid in the heating chamber during the rotor is rotated. For this reason, although the rotor is axially moveable, the rotor is maintained at the substantially axially neutral position in the heating chamber at all times even while the rotor is being rotated. Accordingly, it is possible to solve the problems that the quantity of heat generated by viscous fluid is decreased and viscous fluid is deteriorated, due to the uneven distribution of the viscous fluid.

Preferably, the wedge effect producing means comprises at least three inclined recesses extending circumferentially in the rotor and having bottoms formed gradually shallower in a direction opposite to the rotational direction of the rotor, the inclined recesses are arranged at circumferentially constant intervals and at radially equal positions from the center of the rotor.

In this viscous fluid type heat generator, the pressure of the viscous fluid existing between each inclined recess and the front and the rear wall surfaces of the heating chamber opposed to the inclined recess, while the rotor is rotating, is lowest at the deepest portion of the bottom of the inclined recess and gradually increased as the bottom becomes shallower. Due to the inclination of pressure of the viscous fluid on both sides of the rotor, the wedge effect is produced to correct an axial offset of the rotor in the heating chamber. The inclined recesses are arranged in the circumferential direction of the rotor at constant intervals, and at positions radially equally spaced from the center of the rotor, so the wedge effect can be provided uniformly in the circumferential direction and the radial direction of the rotor. Accordingly, it is possible to prevent the rotor from being inclined with respect to the axis of the drive shaft, and also it is possible to positively maintain the rotor at the axially substantially neutral position in the heating chamber.

In this connection, these inclined recesses as the wedge effect producing means of the invention have a function to extend the liquid-tight clearance when the rotor is rotated, which will be described below.

Preferably, the rotor has through-holes axially penetrating the rotor, so that the liquid-tight clearance can be changed to enlarge the latter during the rotation of the rotor, and each inclined recess is formed in each of the front end surface and the rear end surface of the rotor by chamferring an edge portion of the through-hole on the trailing side thereof with respect to the rotational direction of the rotor.

Here, the liquid-tight clearance is defined as a space in which a sufficiently high shearing force is given to the viscous fluid to cause the latter to be heated to a considerably high temperature based on the rotation of the rotor.

In this viscous fluid type heat generator, by the provision of these through-holes, the liquid-tight clearance between the outer surface of the rotor and the wall surface of the heating chamber can be greatly changed to enlarge when the rotor is rotated, and the molecule binding action can be promoted in the viscous fluid by this change in the liquid-tight clearance. By this molecule binding action, the following rotation of the viscous fluid caused by the rotation of the rotor can be restricted, so that the intensity of the shearing force of viscous fluid can be increased.

Further, gas or bubbles mixed in the viscous fluid are collected in the through-holes, so no gas is left in the liquid-tight clearance between the outer surface of the rotor and the wall surface of the housing, that is, no gas is left in the liquid-tight clearance except for the through-holes and the inclined recesses. Therefore, it becomes possible to give a shearing force to the viscous fluid more effectively.

Accordingly, a quantity of heat generated in the viscous fluid can be effectively increased by the enhancement of the intensity of the shearing force given to the viscous fluid.

Since the viscous fluid flows to the front and the rear of the rotor via the through-holes, the pressure distribution of the viscous fluid on both sides of the rotor is made uniform. Therefore, a quantity of the viscous fluid on the front side of the rotor and a quantity of viscous fluid on the rear side of the rotor can be made uniform. Especially, by chamferring an edge portion of the through-hole on the trailing side thereof in view of the rotational direction of the rotor to form the above inclined recess, no viscous fluid stays in the inner edge portion on the opposite side with respect to the rotational direction of the rotor, that is, all viscous fluid is guided to the inclined recess, so that it can flow smoothly. Therefore, the fluidity of the viscous fluid can be enhanced at the front and the rear of the rotor. Due to the foregoing, it is possible to effectively prevent a quantity of generated heat from being decreased by the uneven distribution of the viscous fluid.

Preferably, the through-holes are formed in a relatively outer circumferential region of the front end surface and the rear end surface of the rotor. In this connection, the aforementioned outer circumferential region is defined as a region, which is away from the rotor center by more than $r_0/2$, wherein $r_0$ is the radius of the rotor.

In this viscous heater, since the through-holes are provided in the outer circumferential region of the rotor, and the inclined recesses formed at the edge portions of the through-holes on the trailing side thereof with respect to the rotational direction of the rotor is also provided in the outer circumferential region of the rotor, the aforementioned wedge effect acts in the outer circumferential region of the rotor. For this reason, it is possible to more reliably prevent the rotor from inclining with respect to the axis of the drive shaft.

When a comparison is made between the outer circumferential region of the rotor and the inner circumferential region thereof, the distance of the outer circumferential region from the axial center is larger than the distance of the inner circumferential region from the axial center, and the circumferential speed of the outer circumferential region is higher than that of the inner circumferential region. Accordingly, for the generation of frictional torque by shearing the viscous fluid, the outer circumferential region contributes more than the inner circumferential region. Consequently, by providing the through-holes in the outer circumferential region of the rotor, frictional torque generated by shearing the viscous fluid can be effectively increased, and thus, a quantity of heat generated in viscous fluid can be effectively increased.

It is inevitable that gas remains in the viscous fluid accommodated in the heating chamber. Therefore, when the viscous fluid type heat generator is left stopped, the viscous fluid flows to a lower portion of the heating chamber due to the weight of viscous fluid itself and gas stays.in an upper portion of the heating chamber. Especially, in the viscous fluid type heat generator described in claim 6 or 7 which includes a storage chamber or a control chamber communicated with the heating chamber concerned, these chambers usually accommodate a volume of viscous fluid which is smaller than a total of the accommodating volume of the heating chamber and the storage chamber or the control chamber. Consequently, when the operation of the viscous heater is stopped, a large quantity of gas exists in an upper portion of the heating chamber. In the case where the operation of the viscous fluid type heat generator is started under the condition in which the viscous fluid stays in a lower portion of the heating chamber, it takes a long time to spread the viscous fluid to the entire heating region (the entire circumference of the rotor) if only the frictional resistance forces generated on the front and the rear side of the rotor caused by the rotation are utilized, and the warming-up of the viscous fluid type heat generator is not quick.

From the above point of view, this viscous fluid type heat generator has through-holes in the outer circumferential region of the rotor, so these throughholes has an oil-scraping effect when the rotor is rotated in the same manner as that of a gear pump. That is, the through-holes can scrape up the viscous fluid as follows. When the viscous fluid type heat generator is stopped, some of the through-holes provided in the outer circumferential region of the rotor are dipped in the viscous fluid held in a lower portion of the heating chamber, and with the rotation of the rotor after the viscous fluid type heat generator has been set in motion, the viscous fluid held in these through-holes is lifted up to an upper portion of the heating chamber. Consequently, it is possible to quickly spread the viscous fluid, which was held in the lower portion of the heating chamber, to the entire heating region immediately after the viscous fluid type heat generator is started. In particular, since the through-holes are arranged in the outer circumferential region of the rotor, it is possible to quickly spread the viscous fluid to the entire circumference of the rotor which greatly contributes to the generation of frictional torque by shearing the viscous fluid. In this way, the warming up of the viscous fluid type heat generator can be improved.

Preferably, the through-holes have right angled edges.

In this viscous fluid type heat generator, because of the squarish protruding corners, a molecule binding action of the viscous fluid can be further promoted. Therefore, it is possible to give a shearing force to the viscous fluid more effectively. Further, gas has been once collected in the through-holes by the action of the right angled edges, so it is difficult to flow outside. Accordingly, the gas storing capacity of the through-holes can be enhanced.

Preferably, the housing has a storage chamber communicating with the heating chamber via a collecting passage and a supplying passage to accommodate a volume of viscous fluid exceeding the volume of the viscous fluid accommodated in the heating chamber.

In this viscous fluid type heat generator, the storage chamber can accommodate a volume of viscous fluid which exceeds the capacity of the clearance. Accordingly, it is unnecessary to severely control the volume for accommodating the viscous fluid.

In the case where the collecting passage is communicated with the central region of the heating chamber, the viscous fluid collected into the central region of the heating chamber by the Weissenberg effect and the movement of gas can be quickly collected from the heating chamber into the storage chamber via the recovery passage, and the viscous fluid can be supplied from the storage chamber into the heating chamber via the supplying passage. In the manner described above, in this viscous heater, while the viscous fluid is being exchanged between the heating chamber and the storage chamber, it is possible to ensure a sufficiently large accommodating volume of viscous fluid to generate heat and, further, when a ratio of the volume of the accommodated viscous fluid is increased, it is possible to prevent the deterioration of the shaft seal capacity of the shaft seal device even if the inner pressure is raised.

In this viscous fluid type heat generator, it is possible to accommodate in the storage chamber a volume of viscous fluid exceeding the volume of the clearance formed in the viscous fluid type heat generator, so there is a sufficiently large quantity of viscous fluid to be sheared, and a specific part of the viscous fluid is not always sheared, and therefore, the deterioration of the viscous fluid can be delayed.

Further, in this viscous fluid type heat generator, a cross-sectional area between the rear end surface of the rotor and the rear wall surface of the heating chamber is smoothly changed by the existence of the inclined recesses. When the cross-sectional area of the passage of viscous fluid is smoothly changed, the viscous fluid easily flows from the storage chamber into the heating chamber via the supplying passage. Due to the foregoing, viscous fluid can be more smoothly circulated between the storage chamber and the heating chamber. As a result, the deterioration of viscous fluid can be delayed more effectively.

In this viscous fluid type heat generator, when the operation of this viscous fluid type heat generator is stopped, a large quantity of gas stays in the upper portion of the heating chamber. Accordingly, by the action of the through-holes provided in the outer circumferential regions on the front and rear end surfaces of the rotor, the function of the oil-scraping effect is more effectively improved. In this connection, in this viscous fluid type heat generator, when the operation of this viscous fluid type heat generator is stopped, a large quantity of gas stays in the upper portion of the heating chamber. Accordingly, not only the through-holes provided in the outer circumferential region on the front and the rear end surface of the rotor but also the through-holes provided in the inner circumferential region can exhibit the oil scraping effect described before.

Preferably, the housing includes a collecting passage communicated with the heating chamber, a supplying passage communicated with the heating chamber, and a control chamber communicated with the collecting passage and the supplying passage, at least one of the collecting passage and the supplying passage is capable of being opened and closed, the viscous fluid is collected from the heating chamber into the control chamber via the collecting passage so as to decrease the heating capacity, and the viscous fluid is supplied from the control chamber into the heating chamber via the supplying passage so as to increase the heating capacity.

In this viscous fluid type heat generator, in the housing, there is provided a control chamber communicated with the heating chamber via the collecting passage and the supplying passage. At least one of the collecting passage and the supplying passage can be opened and closed. Therefore, the viscous fluid is fed from the control chamber into the heating chamber via the supplying passage that is opened, and also viscous fluid is collected from the heating chamber into the control chamber via the collecting passage that is opened.

When a quantity of viscous fluid to be collected and a quantity of viscous fluid to be supplied is adjusted by opening and closing the collecting passage and/or the supplying passage, a quantity of viscous fluid existing in the heating chamber is adjusted, so that a quantity of heat generated in viscous fluid can be changed, that is, a capacity of the viscous fluid type heat generator can be changed.

In this viscous fluid type heat generator, when the viscous fluid is collected from the heating chamber into the control chamber, or on the contrary, when the viscous fluid is supplied from the control chamber into the heating chamber, the total of the volumes of the heating chamber, the collecting passage, the supplying passage and the control chamber is not changed. Therefore, when the viscous fluid is moved, no negative pressure is generated. Due to the foregoing, even when the heating chamber is communicated with the atmosphere, the viscous fluid does not come into contact with fresh air, and no moisture is drawn from the atmosphere at any time. Accordingly, no deterioration is caused in the viscous fluid.

Except for the case in which a forcible supplying means is specially provided and the supplying passage is communicated with the central region of the heating chamber by the forcible supplying means, it is preferable that the supplying passage is communicated with the outer circumferential region of the heating chamber. This is because, by the Weissenberg effect, the viscous fluid supplied to the outer circumferential region of the heating chamber easily spreads to the entire region of the heating chamber including the central region. Due to the foregoing, a quantity of heat generated in the liquidtight clearance formed between the wall surface of the heating chamber and the outer surface of the rotor can be quickly increased.

Consequently, the capacity of this viscous heater can be reliably reduced and, even after the viscous fluid type heat generator has been used over a long period of time, the heating efficiency is not lowered. Since the capacity of the viscous fluid type heat generator can be reliably controlled as described above, an electromagnetic clutch is not necessarily in the case where heating operation is changed. Accordingly, the manufacturing cost and the weight of the viscous heater can be reduced.

In this viscous heater, the cross-sectional area between the rear end surface of the rotor and the rear wall surface of the heating chamber is smoothly changed by the inclined recesses. When the cross-sectional area of the passage of viscous fluid is smoothly changed as described above, viscous fluid easily flows from the control chamber into the heating chamber via the feed passage. Due to the foregoing, viscous fluid can be quickly fed from the control chamber into the heating chamber, so that a quantity of generated heat can be quickly increased.

In this viscous fluid type heat generator, when the operation of this viscous fluid type heat generator is stopped, a large quantity of gas stays in the upper portion of the heating chamber. Accordingly, by the action of the through-holes provided in the outer circumferential regions on the front and the rear end surface of the rotor, an oil-scraping effect is improved effectively. In this connection, in this viscous fluid type heat generator, when the operation of this viscous fluid type heat generator is stopped, a large quantity of gas stays in the upper portion of the heating chamber. Accordingly, not only the through-holes provided in the outer circumferential region on the front and the rear end surface of the rotor but also the through-holes provided in the inner circumferential region can exhibit the oil scraping effect described before.

In such an operating condition that heating is conducted too intensely, and a quantity of viscous fluid in the heating chamber is decreased in order to reduce a quantity of generated heat, and thereafter the situation is returned from the capacity reduced condition to the capacity increased condition, if a quantity of viscous fluid is decreased excessively during the capacity reduced condition, a problem may arise that the decreased capacity can not be quickly returned to the increased capacity.

In order to solve the above problems, in this viscous fluid type heat generator, even if a quantity of viscous fluid in the heating chamber is too small and the rotor is rotated at a low speed, the oil-scraping effect can be provided by the through-holes arranged in the outer circumferential region on the front and the rear end surface of the rotor. Accordingly, the viscous fluid held in the lower portion of the heating chamber can be quickly spread to the entire heating region. Therefore, it is possible to quickly return the viscous heater from the condition in which the capacity is decreased to the condition in which the capacity is increased.

BRIEF DESCRIPTION OF THE DRAWINGS

The preferred embodiments of the present invention will now be described, with reference to the accompanying drawings in which.

DESCRIPTION OF THE PREFERRED EMBODIMENTS

EMBODIMENT 1

Figure 1:
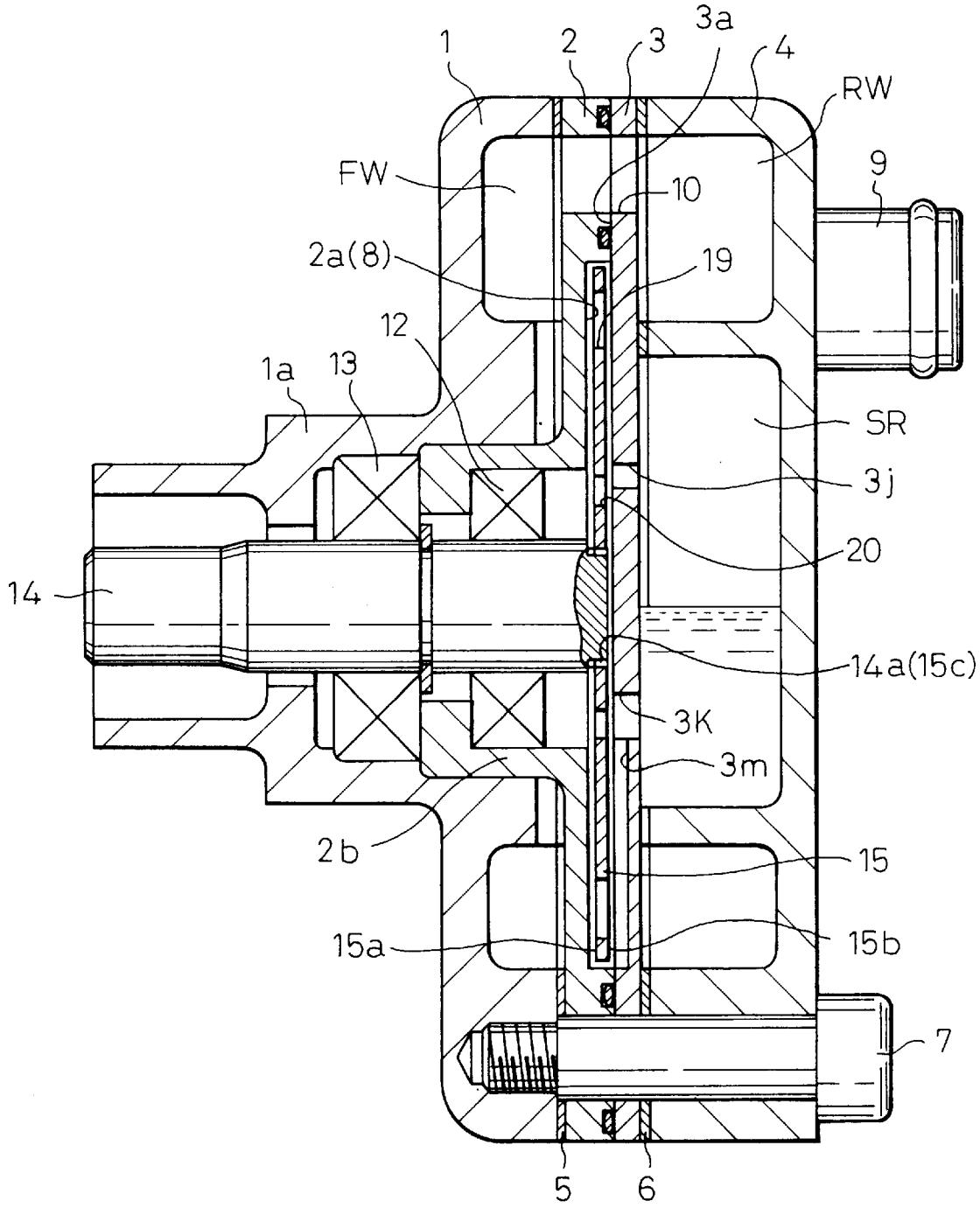
FIG. 1 is a cross-sectional view of the viscous fluid type heat generator of the first embodiment of the present invention.

The viscous fluid type heat generator includes a front housing body 1, a front plate 2, a rear plate 3 and a rear housing body 4, wherein a gasket 5 is interposed between the front housing body 1 and the front plate 2, and a gasket 6 is interposed between the rear plate 3 and the rear housing body 4 in such a manner that the components are laminated on each other and fastened by a plurality of through-bolts 7, to facilitate the manufacture, as shown in FIG. 1. Here, the front housing body 1 and the front plate 2 form a front housing, and the rear plate 3 and the rear housing body 4 form a rear housing. The front plate 2 has at the rear end surface thereof a recessed portion 2*a*, the bottom surface of which is flat. The recessed portion 2*a* forms together with a flat front end surface 3*a* of the rear plate 3, a closed heating chamber 8, having a circular cross-section.

The inner surface of the front housing body 1 and the front end surface of the front plate 2 form a front water jacket FW adjacent to the front portion of the heating chamber 8, the front water jacket FW acting as a front heat radiating chamber. The rear end surface of the rear plate 3 and the inner surface of the rear housing body 4 form a rear water jacket RW adjacent to the rear portion of the heating chamber 8, the rear water jacket RW acting as a rear heat radiating chamber.

A water inlet port 9 and a water outlet port (not shown) are formed in the outer region on the rear surface of the rear housing body 4, adjacent to each other. Both the water inlet port 9 and the water outlet port are communicated with the rear water jacket RW. A plurality of water passages 10 which are arranged through the rear plate 3 and the front plate 2, at regular intervals between the through-bolts 7, so that the front water jacket FW and the rear water jacket RW are communicated with each other by the water passages 10.

Figure 2:
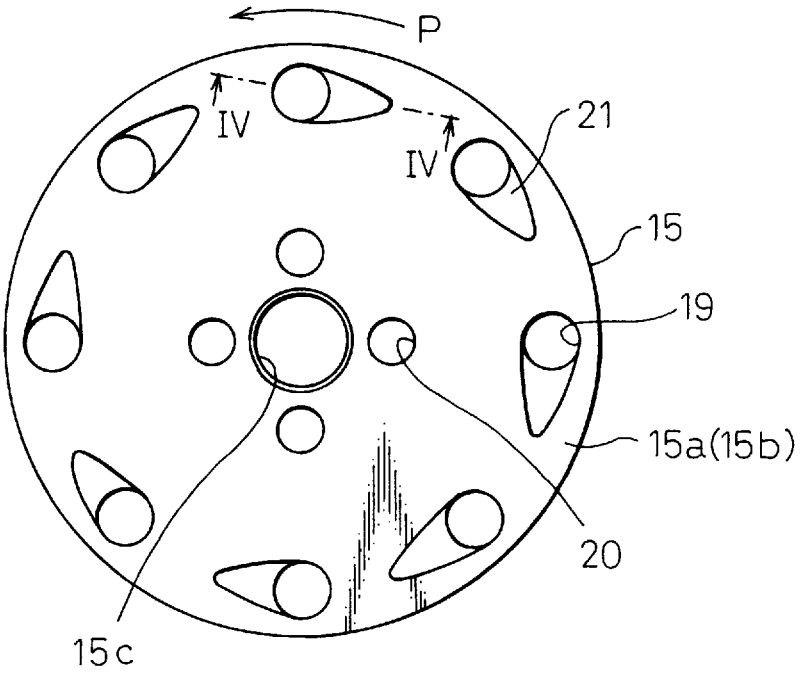
FIG. 2 is a plan view of the rotor of the viscous fluid type heat generator of FIG. 1.

A shaft seal device 12 is provided in the boss 2*b* of the front plate 2, adjacent to the heating chamber 8. A bearing device 13 is provided in the boss la of the front housing body 1. A drive shaft 14 is rotatably supported by the shaft seal device 12 and the bearing device 13. As shown in FIG. 2, a flat disk-shaped rotor 15 having a front and rear end surfaces is operably coupled to the rear end of the drive shaft 14, the radius of the rotor 15 about the axial center of the drive shaft 14 being longer than the length of the shaft. The rotor 15 is rotatable in the heating chamber 8. Outer diameter of the rotor 15 is a little smaller than the inside diameter of the heating chamber 8. Between the front end surface 15*a* of the rotor 15 and the front wall surface of the heating chamber 8, and between the rear end surface 15*b* of the rotor 15 and the rear wall surface of the heating chamber 8, there are liquid-tight clearances CL, respectively, and in this case, each liquid-tight clearances CL is determined to be $0.003\times r_0$, wherein the radius of the rotor is $r_0$.

The viscous fluid type heat generator is characterized in that an outer spline 14*a* is formed at the rear end of the drive shaft 14, and this outer spline 14*a* is engaged with -an inner spline 15*c* of the rotor 15. In this way, the rotor 15 is fitted on the drive shaft 14 in such a manner that the rotor 15 can not rotate relative to the drive shaft 14 and the rotor 15 can be inclined with respect to the axis of the drive shaft 14 and can move axially relative to the drive shaft 14.

Silicon oil, which functions as a viscous fluid, is contained in the heating chamber 8, the silicon oil existing in the aforementioned liquid-tight clearances. At the front end of the drive shaft 14, there is provided a pulley or an electromagnetic clutch (not shown), which is rotated by the engine of-the vehicle via a belt.

Figure 3:
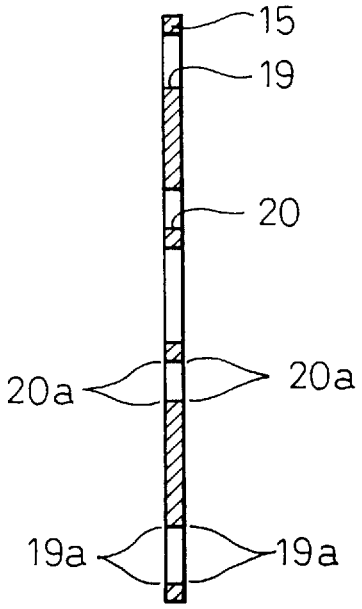
FIG. 3 is a cross-sectional view of the rotor of the viscous fluid type heat generator of FIG. 2.
Figure 4:
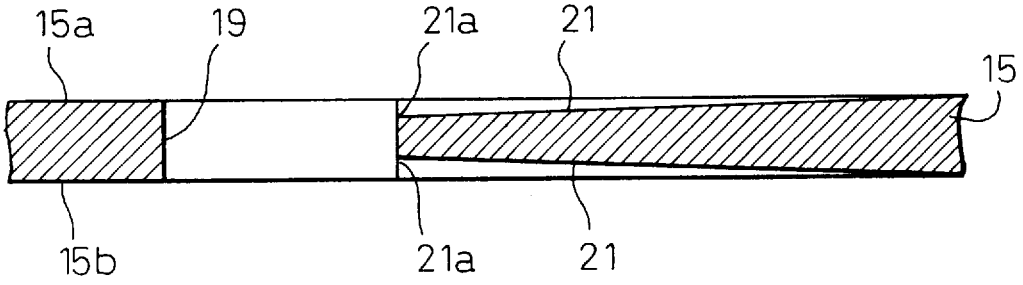
FIG. 4 is a partially enlarged cross-sectional view of the rotor of the viscous fluid type heat generator, taken along the line IV–IV in FIG. 2.

In addition, as shown in FIGS. 2, 3 and 4, the rotor 15 of the viscous fluid type heat generator has eight outer circumferential circular holes (through-holes) 19 at the outer circumferential region of the rotor 15 at circumferentially constant intervals and at radially equal positions from the center of the rotor 15. In the inner circumferential region of the rotor 15, there are provided four inner circumferential circular holes (through-holes) 20 at circumferentially constant intervals. The outer circumferential circular holes 19 and the inner circumferential circular holes 20 axially penetrate the rotor 15 and form through-holes which change the liquid-tight clearances to enlarge the latter when the rotor 15 is rotated.

The centers of the outer circumferential circular holes 19 are located at positions apart from the center of the rotor 15 by a distance of $0.86\times r_0$ and the radius of the outer circumferential circular holes 19 is $0.09\times r_0$, wherein the radius of the rotor 15 is $r_0$. On the other hand, the centers of the inner circumferential circular holes 20 are located at positions apart from the center of the rotor 15 by a distance of $0.33\times r_0$ and the radius of the inner circumferential circular hole 20 is $0.06\times r_0$, wherein the radius of the rotor 15 is $r_0$. Edges of the outer circumferential circular holes 19 and the inner circumferential circular holes 20 are not chamfered, so that the outer circumferential circular holes 19 have right angled edges 19*a* and the inner circumferential circular holes 20 have right angled edges 20*a*.

In addition, the rotor 15 has inclined recesses 21 formed in the front end surface 15*a* and the rear end surface 15*b* of the rotor 15, by chamferring edge portions of the outer circumferential circular holes 19 on the trailing side of the holes 21 in view of the rotational direction (P in FIG. 2) of the rotor 15. As shown in FIGS. 2 and 4, each inclined surface 21 extends circumferentially in the rotor 15, and the bottoms of the inclined recessed 21 gradually becomes shallower in the direction opposite to the rotational direction of the rotor 15. In the same manner as the outer circumferential circular holes 19, the inclined recesses 21 are arranged at circumferentially constant intervals and at radially equal positions from the center of the rotor 15. The inclined recesses 21 function as wedge effect producing means for correcting an axial offset of the rotor 15 in the heating chamber 8 by a wedge effect caused by the pressure of viscous fluid during rotation of the rotor.

In the inner circumferential region of the rotor 15, in which the above described inner circumferential circular holes 20 are formed, a large clearance exists between the front end surface 15*a* of the rotor 15 and the shaft sealing device 12. This clearance is not included in the aforementioned liquid-tight clearance.

In this viscous fluid type heat generator, there is provided a storage chamber SR in the central region of the rear housing body 4. There is provided a collecting hole 3*j* as a collecting passage, at an upper position in the central region of the rear plate 3. There are provided a supplying hole 3*k* at a lower position of the central region of the rear plate 3, and a supplying groove 3*m* extending from the lower end of the supplying hole 3*k* to the outer region in the lower side of the heating chamber 8. In this connection, the supplying hole 3*k* and the supplying groove 3*m* form a supplying passage, the cross-sectional area of which is larger than the cross-sectional area of the collecting hole 3*j* so that silicon oil, which is a viscous fluid, can be easily supplied into the heating chamber 8. It is preferable that the supplying groove 3*m* is formed longer than the corresponding portion of the rotor 15.

In this viscous heater incorporated into a heating unit of a vehicle, when the drive shaft 14 is driven by an engine via a pulley, the rotor is rotated in the heating chamber 8 since the rotor 15 is engaged with the drive shaft 14 in such a manner that the rotor 15 can not rotate relative to the drive shaft 14, so that silicon oil is heated by the shearing action in the liquid-tight clearances formed between the wall surfaces of the heating chamber 8 and the end surfaces of the rotor 15. The thus generated heat is heat-exchanged with the circulating water in the front and rear water jackets FW and RW and circulating water is heated. The thus heated circulating water is sent to the heating unit and used for heating the compartment in the vehicle.

In the operation of this viscous fluid type heat generator, a belt tension will inevitably act on a pulley directly connected with the drive shaft 14 due to a change in the engine speed and, due to this belt tension, the drive shaft 14 is rotated being inevitably inclined with respect to the ideal position of the drive shaft 14. Due to the tolerance allowed in the manufacturing process, it is difficult to manufacture the viscous fluid type heat generator with perfect accuracy, that is, the squareness of the drive shaft 14 and the rotor 15, the parallelism of the rotor 15 and the heating chamber 8, and the dimensions of the rotor 15 and the heating chamber 8 in the axial direction, are not perfectly accurate. However, in this viscous fluid type heat generator, the inclination of the drive shaft and the rotor can be absorbed by the fact that the rotor 15 is fitted on the drive shaft 14 in such a manner that the rotor 15.can be inclined with respect to the axis of the drive shaft 14, and the aforementioned differences in the dimensions can be absorbed, by the fact that the rotor 15 is fitted on the drive shaft 14 in such a manner that the rotor 15 can axially move. In other words, the central surface of the rotor 15 substantially coincides with the central surface of the heating chamber 8.

Accordingly, in this viscous fluid type heat generator, the liquid-tight clearances formed between the wall surfaces of the heating chamber 8 and the end surfaces of the rotor 15 can be somewhat reduced so that silicon oil can be easily sheared in order to increase a quantity of heat generated per one revolution of the rotor 15, and in this case, the end surfaces of the rotor 15 will tend not to interfere with the wall surfaces of the heating chamber 8. In addition, any contact of the end surfaces of the rotor 15 with the wall surfaces of the heating chamber 8, which contact may arise when the rotor 15 is inclined with respect to the axis of the drive shaft 14 and the rotor 15 is displaced in the axial direction of the drive shaft 14, can be reliably avoided since the rotor 15 is substantially held at an axially neutral position in the heating chamber 8 by the wedge effect produced by the inclined recesses 21.

Accordingly, in the viscous fluid type heat generator of the first embodiment, it is possible to prevent the interference between the end surfaces of the rotor 15 and the wall surfaces of the heating chamber 8 while a large quantity of heat generated per one revolution of the rotor 15 is maintained, and therefore, it is possible to provide a large heating capacity and a high durability to the viscous fluid type heat generator of the invention.

In this viscous fluid type heat generator, the pressure of viscous fluid existing between the inclined recesses 21 and the front and rear wall surfaces of the heating chamber 8 (the rear surface of the recessed portion 2*a* of the front plate 2 and the front surface 3*a* of the rear plate 3) opposed to the inclined recesses 21 is lowest at a position of the deepest point 21*a* of the bottom of the inclined recesses 21 and gradually raised as the bottom becomes shallower from the deepest point 21*a* of the bottom. By this inclination of pressure of viscous fluid generated on both sides of the rotor 15, the wedge effect can be produced so that an axial offset of the rotor 15 can be corrected in the heating chamber 8. Since the inclined recesses 21 are arranged in the rotor 15 at circumferentially constant intervals and at radially equal positions from the center of the rotor 15, the aforementioned wedge effect can be uniformly provided in the circumferential and radial directions of the rotor 15. Accordingly, while the inclination of the rotor 15 with respect to the axis of the drive shaft 14 is prevented, the rotor 15 can be substantially maintained at the neutral position with respect to the axial direction in the heating chamber 8. Consequently, a decrease in the generated heat caused by an uneven distribution of the viscous fluid can be prevented, and deterioration of the viscous fluid can be also prevented.

Especially, in this viscous heater, the outer circumferential circular holes 19 are arranged in the outer circumferential region of the rotor, and the inclined recesses 21 formed in the edge portions of the outer circumferential circular holes 19 on the side opposite to the rotational direction of the rotor 15 are also arranged in the outer circumferential region of the rotor. Accordingly, the aforementioned wedge effect is provided in the outer circumferential region of the rotor. Due to the above structure, it is possible to reliably prevent the rotor 15 from inclining with respect to the axis of the drive shaft 14.

Further, the viscous fluid type heat generator is provided with the outer circumferential circular holes 19 and the inner circumferential circular holes 20. Therefore, the liquid-tight clearances formed between the front and rear wall surfaces of the heating chamber 8 and the front and rear end surfaces 15*a* and 15*b* of the rotor 15 change in the circumferential direction, the liquid-tight clearances are greatly enlarged when the rotor 15 is rotated. By these changes of the liquid-tight clearances, the binding action of the molecules in the viscous fluid can be promoted. By this action, the rotation of viscous fluid following the rotation of the rotor 15 is restricted, so that the intensity of the shearing force given to the viscous fluid is increased.

Especially, in this viscous heater, the outer circumferential circular holes 19 of predetermined dimensions are formed in the predetermined range in the outer circumferential region of the rotor 15 so that in the outer circumferential region of the rotor 15 which greatly contributes to the generation of frictional torque, the shearing force can be very effectively given to the viscous fluid by the outer circumferential circular holes 19.

In this viscous fluid type heat generator, gas mixed in the viscous fluid is collected in the outer circumferential circular holes 19 and the inner circumferential circular holes 20, so no gas exists in the liquid-tight clearances (the clearances formed in portions except for the outer circumferential circular holes 19, the inner circumferential circular holes 20 and the inclined recesses 21), which are effective heating regions, formed between the outer surfaces of the rotor 15 and the front and rear wall surface of the heating chamber 8. Therefore, it is possible to effectively give a shearing force to the viscous fluid.

The outer circumferential circular holes 19 and the inner circumferential circular holes 20 respectively have right angled edges 19*a* and 20*a*, so it is possible to effectively facilitate the binding action of molecules in the viscous fluid, and it is possible to more effectively give a shearing force to viscous fluid, compared with the case in which these edges are chamfered. Further, gas collected in the outer circumferential circular holes 19 and the inner circumferential circular holes 20 is not likely to escape outside, and the gas storing capacity can be increased, and the intensity of the shearing force given to the viscous fluid can be increased.

In this connection, the effective heating region is decreased, by the provision of the outer circumferential circular holes 19, the inner circumferential circular holes 20 and the inclined recesses 21, but the intensity of the shearing force can be remarkably increased by the aforementioned binding action given to molecules in viscous fluid. Therefore, a quantity of generated heat can be effectively increased.

As described above, when this viscous fluid type heat generator is used, it is possible to increase a quantity of generated heat without extending the effective heating region.

Further, since the outer circumferential circular holes 19 and inner circumferential circular holes 20 are formed in the rotor 15, it is possible to circulate the viscous fluid between the front and the rear of the rotor 15. Especially, since the edge portions of the outer circumferential circular holes 19 on the trailing opposite side thereof in view of the rotational direction of the rotor 15 are chamfered so as to form the inclined recesses 21, no viscous fluid stays in the inner end portions of the outer circumferential circular holes 19 on the trailing side thereof in view of the rotational direction of the rotor 15, and the viscous fluid is guided by the inclined recesses 21 and flows easily. As a result, the fluidity of the viscous fluid can be enhanced between the front and the rear of the rotor 15. For this reason, the pressure distribution of the viscous fluid on both sides of the rotor 15 can be made uniform, and the quantity of viscous fluid on the front side is made equal to the quantity of viscous fluid on the rear side of the rotor 15. Accordingly, the deterioration of a quantity of generated heat caused by the. uneven distribution of the viscous fluid can be effectively avoided.

In this viscous fluid type heat generator, the outer circumferential circular holes 19 are arranged in the outer circumferential region of the rotor 15, so these outer circumferential circular holes 19 can provide an oil-scraping effect. That is, under the condition that the viscous fluid type heat generator is left stopped, some of the outer circumferential circular holes 19 arranged in the outer circumferential region are in the viscous fluid which is held in the lower portion of the heating chamber 8 by its weight due to the existence of gas inevitably remaining in the heating chamber 8, and when the viscous fluid type heat generator is then operated and the rotor 15 is rotated, the outer circumferential circular holes 19 which have been in viscous fluid carry the viscous fluid and lift it to the upper portion of the heating chamber 8. Due to the foregoing action, after the viscous fluid type heat generator has been set in motion, the viscous fluid staying in the lower portion of the heating chamber 8 can be quickly spread to the entire region of the effective heating region. In this way, operation of the viscous fluid type heat generator can be quickly started.

The storage chamber SR is arranged in this viscous fluid type heat generator and a large quantity of gas exists in the upper portion of the heating chamber 8, so the oil-scraping effect by the outer circumferential circular holes 19 of the rotor 15 is enhanced, compared with a viscous heater in which no storage chamber SR is arranged. Under the condition that this viscous fluid type heat generator is left stopped, a large quantity of gas exists in the upper portion of the heating chamber 8, so the oil-scraping effect is ensured not only by the outer circumferential circular holes 19 but also by the inner circumferential circular holes 20.

In this viscous fluid type heat generator, the storage chamber SR can accommodate a volume of viscous fluid larger than the accommodating volume of viscous fluid in the heating chamber 8, so it is unnecessary to severely control the accommodating volume of viscous fluid. In this viscous fluid type heat generator, the storage chamber SR is communicated with the central region of the heating chamber 8, so the viscous fluid collected in the central region of the heating chamber 8 by the Weissenberg effect and the movement of gas can be collected from the heating chamber 8 in the storage chamber SR via the collecting passage 3*j*, and the viscous fluid can be supplied from the storage chamber SR to the outer circumferential region of the heating chamber 8 via the supplying passage 3*k*. Therefore, in this viscous fluid type heat generator, the viscous fluid can move between the heating chamber 8 and the storage chamber SR, so that it is possible to provide a sufficient accommodating volume of viscous fluid necessary for generating a sufficiently large quantity of heat and it is possible to prevent the deterioration of the shaft sealing capacity of the shaft sealing device 12 due to the increase in a ratio of accommodation of viscous fluid.

In this viscous fluid type heat generator, the storage chamber SR can accommodate a volume of viscous fluid larger than the volume of the clearances, so there is a surplus volume of viscous fluid to be sheared, so that a specific volume of viscous fluid is not always subjected to shearing and the deterioration of the viscous fluid can be reduced.

Further, in this viscous fluid type heat generator, the cross-sectional area between the rear end surface 15*b* of the rotor 15 and the rear wall surface of the heating chamber 8 is smoothly changed. By the fact that the cross-sectional area of the viscous fluid passage is smoothly changed, the viscous fluid flows easily from the storage chamber SR to the heating chamber 8 via the supplying passage. Therefore, the circulation of the viscous fluid between the storage chamber SR and the heating chamber 8 can be enhanced, and the deterioration of the viscous fluid can be more effectively delayed.

In this viscous fluid type heat generator, a large quantity of gas exists in the upper portion of the heating chamber 8 under the condition that the viscous fluid type heat generator is left stopped, so the oil-scraping effect by the outer circumferential circular holes 19 arranged in the outer circumferential region of the rotor 15 is enhanced. In this connection, when operation of this viscous fluid type heat generator is stopped, a large quantity of gas exists in the upper portion of the heating chamber 8, and the oil-scraping effect is enhanced not only by the outer circumferential circular holes 19 but also by the inner circumferential circular holes 20.

EMBODIMENT 2

Figure 5:
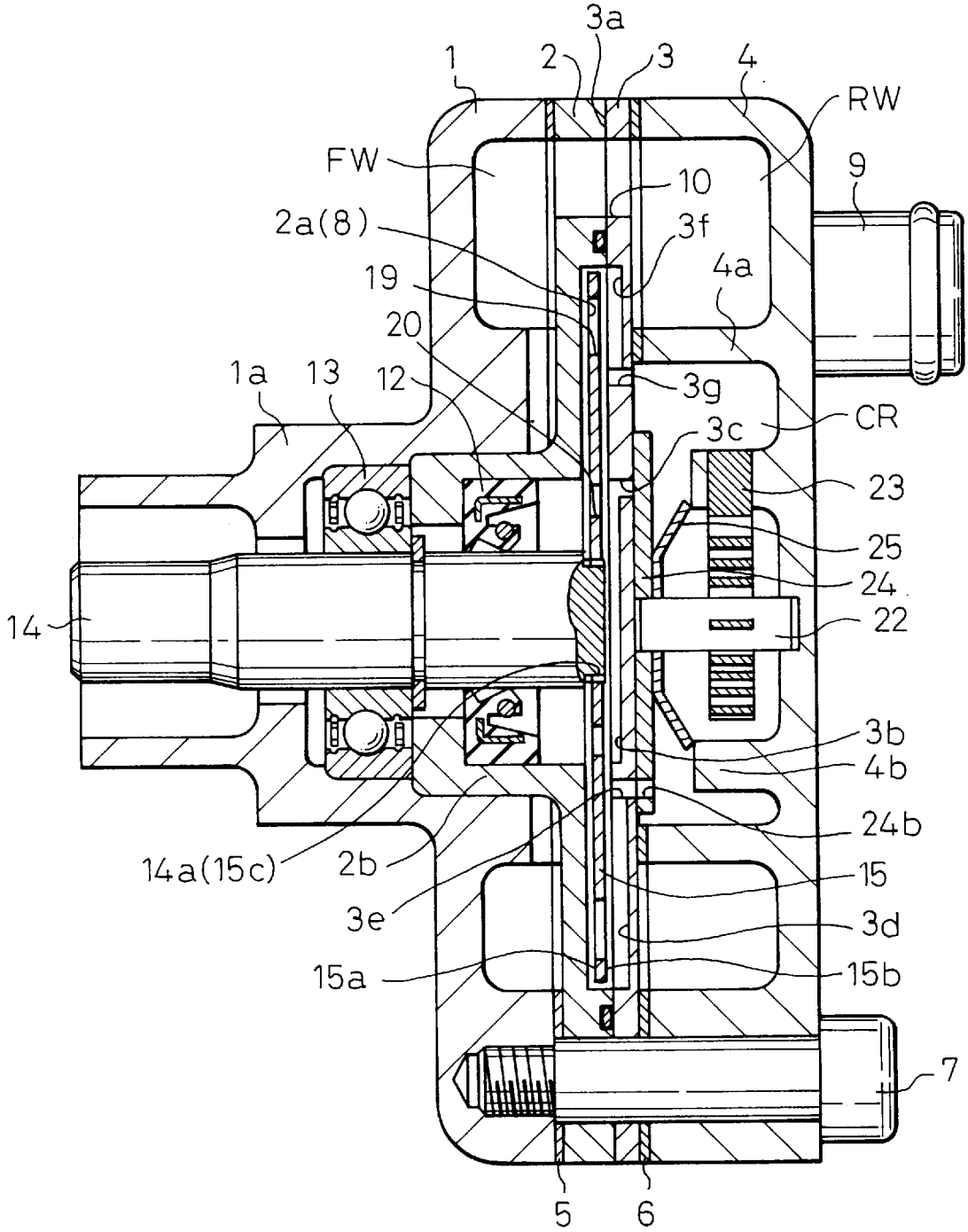
FIG. 5 is a cross-sectional view of the viscous fluid type heat generator of the second embodiment of the present invention.
Figure 7:
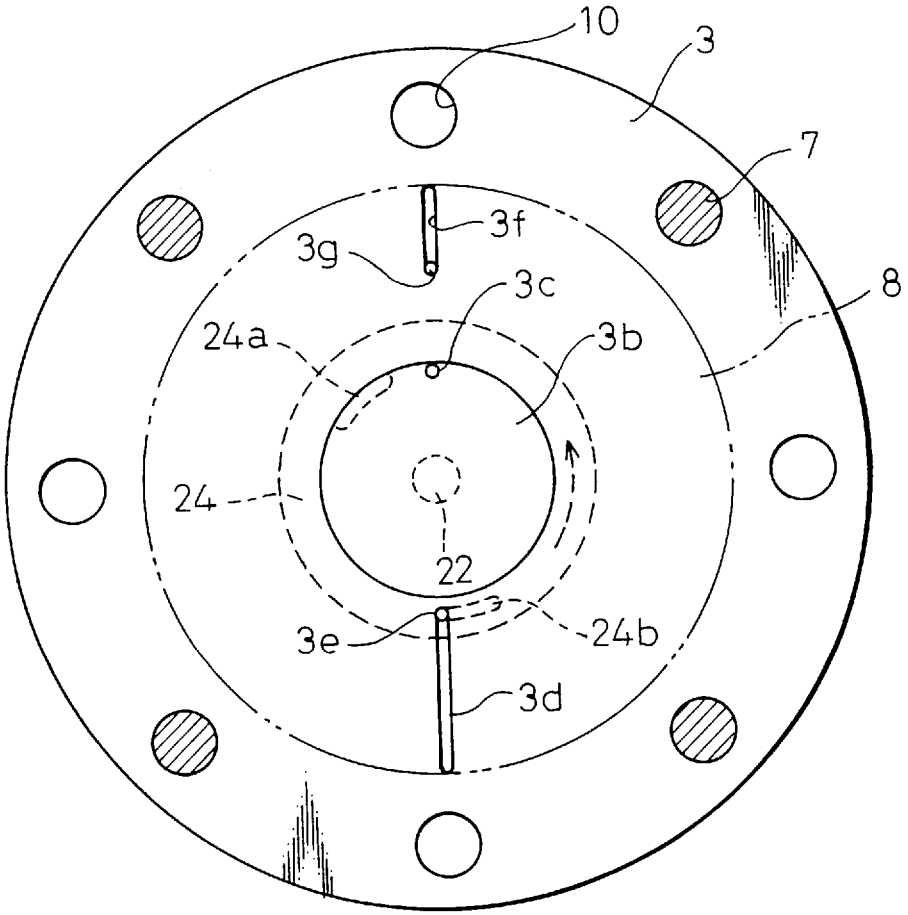
FIG. 7 is a plan view of the rear plate of the viscous heater of FIG. 5, viewed from the front side of FIG. 5 and showing the case of increasing the heating capacity.
Figure 8:
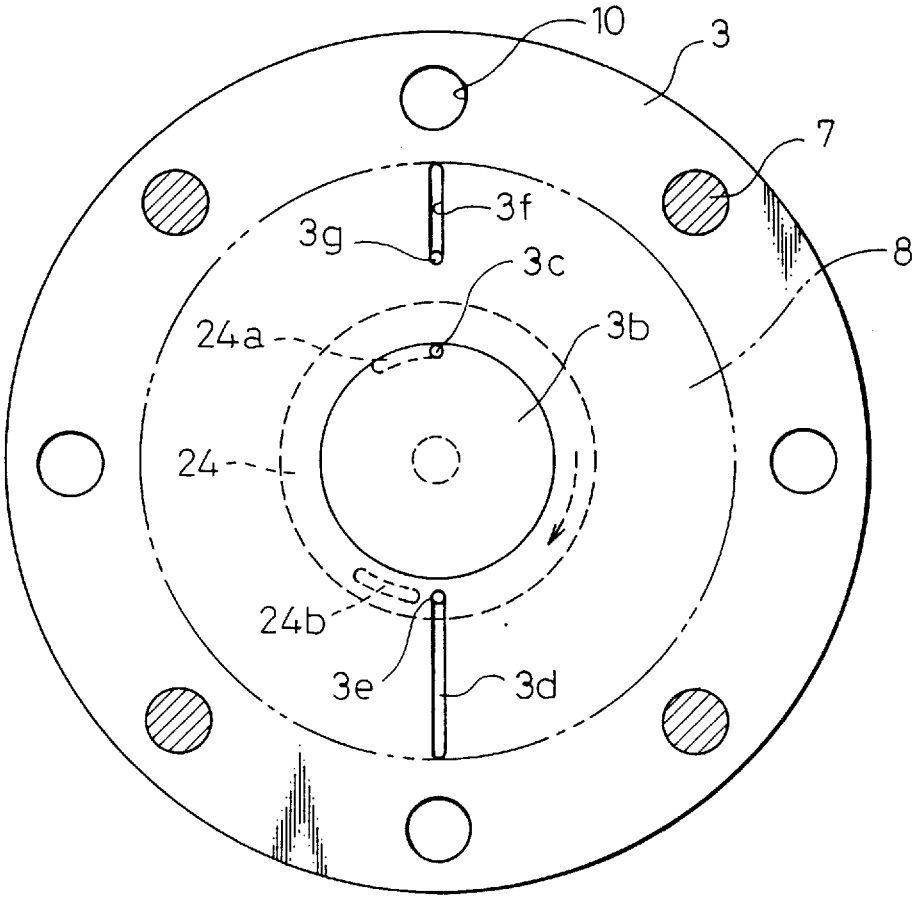
FIG. 8 is a plan view of the rear plate of the viscous heater of FIG. 5, viewed from the front side of FIG. 5 and showing the case of reducing the heating capacity.

As shown in FIGS. 5, 7 and 8, in the viscous fluid type heat generator of this embodiment, a collecting recess 3*b* is arranged in the front end surface 3*a* of the rear plate 3, opposed to the central region of the heating chamber 8, and a first collecting hole 3*c* which penetrates the rear plate 3 to the rear end surface is arranged at a position in the peripheral region of the collecting recess 3*b*. In the front end surface 3*a* of the rear plate 3, a supplying groove 3*d* which extends from the outside on the lower side of the collecting recess 3*b* to the outer lower region of the heating chamber 8, a first supplying hole 3*e* which penetrates to the rear end surface is arranged at a position inside the supplying groove 3*d*. In order to supply the silicon oil, which is a viscous fluid, to the heating chamber 8 easily, the widths or diameters of the supplying groove 3*d* and the first supplying hole 3*e* are larger than the width or diameter of the first collecting hole 3*c*. It is preferable that the supplying groove 3*d* is formed longer than the corresponding portion of the rotor 15. Further, in the front end surface 3*a* of the rear plate 3, there is provided a gas groove 3*f*, which is a portion of the gas passage, extending from a position on the upper outside of the collecting recess 3*b* to the upper outside portion of the heating chamber 8. At a position near the inner end of the gas groove 3*f*, there is provided a gas hole 3*g*, which is the residual portion of the gas passage, penetrating the rear plate 3 to the rear end surface.

As shown in FIG. 5, in the rear housing body 4, there is provided a first rib 4*a* which comes into contact with the gasket 6, wherein the first rib 4*a* protrudes like a ring. The rear end surface of the rear plate 3 and the inner surface of the rear housing body 4 on the outside of the first rib 4*a* compose a rear water jacket RW which is a rear heat radiating chamber adjacent to the rear portion of the heating chamber 8. The rear end surface of the rear plate 3 and the inner surface of the rear housing body 4 on the inside of the first rib 4*a* compose a control chamber CR communicated with the first collecting hole 3*c*, the first supplying hole 3*e* and the gas hole 3*g*.

Figure 6:
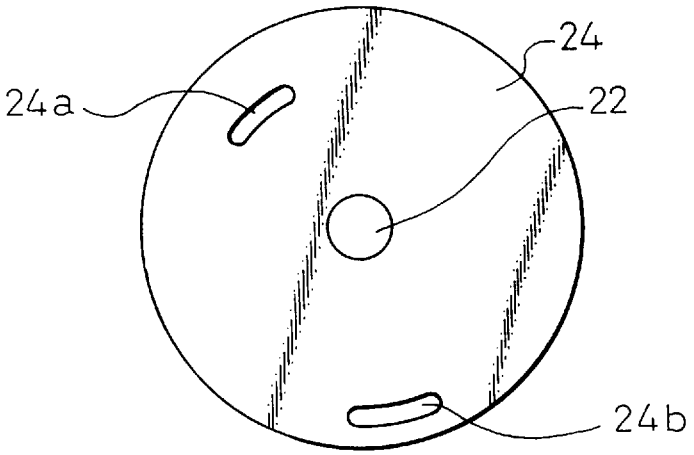
FIG. 6 is a plan view of the rotary valve of the viscous heater of FIG. 5, viewed from the front side in FIG. 5.

A second rib 4*b* protrudes like a ring in control chamber CR of the rear housing body 4, and a valve shaft 22 is rotatably held in the center of the second rib 4*b*. A bimetallic spiral spring 23 which is a temperature sensitive type actuator has an outer end fixed to the second rib 4*b* and an inner end fixed to the valve shaft 22. In this bimetallic spiral spring 23, a certain temperature is predetermined so that it can be displaced when the temperature is too low or too high relative to the set heating temperature. At the front end of the valve shaft 22, there is provided a disk-shaped rotary valve 24 which is a single first or second valve means. This rotary valve 24 is urged by a belleville spring 25, which is an urging means arranged on the front end surface of the second rib 4*b*, in a direction so that the openings of the first collecting hole 3*c* and the first supplying hole 3*e* on the control chamber CR side can be closed. As shown in FIG. 6, in this rotary valve 24, there are provided an arc-shaped second collecting hole 24*a* and second supplying hole 24*b* which are capable of communicating with the first collecting hole 3*c* or the first supplying hole 3*e* according to the rotary angle of the rotary valve 24. In order to smoothly supply silicon oil into the heating chamber 8, the communicating area of the second supplying hole 24*b* is larger than the communicating area of the second collecting hole 24*a*. In this way, the collecting recess 3*b*, the first collecting hole 3*c* and the second collecting hole 24*a* compose the collecting passage, and the supplying groove 3*d*, the first supplying hole 3*e* and the second supplying hole 24*b* compose the supplying passage. In this way, in this viscous fluid type heat generator, the collecting passage 3*b* and the supplying passage 3*c* can be opened and closed, and the shaft length is shortened.

In this connection, silicon oil exists in control chamber CR so that the bimetallic spiral spring 23 is substantially dipped in silicon oil at all times. However, silicon oil exists in the heating chamber 8, the collecting passage 3*b*, the supplying passage 3*d* and control chamber CR, and further air inevitably remains in them in the process of assembly.

Other arrangements are the same as those of the first embodiment 1 described above.

In this viscous fluid type heat generator, when the drive shaft 14 shown in FIG. 5 is driven by the engine, the rotor 15 is rotated in the heating chamber 8. Therefore, silicon oil is sheared and heated in the liquid-tight clearances between the wall surfaces of the heating chamber 8 and the outer surfaces of the rotor 15. The thus generated heat is heat-exchanged with the circulating water which is a circulating fluid circulating in the front FW and the rear water jacket RW. The thus heated circulating water is fed to the heating circuit so that the vehicle compartment can be heated.

If the rotor 15 is being rotated in the meantime, silicon oil in the heating chamber 8 tends to gather into the central region by the Weissenberg effect. Especially, by adopting the aforementioned shapes for the heating chamber 8 and the rotor 15, the area of the liquid surface of silicon oil extending perpendicular to the axis is large, so that the Weissenberg effect can be reliably provided.

Figure 9:
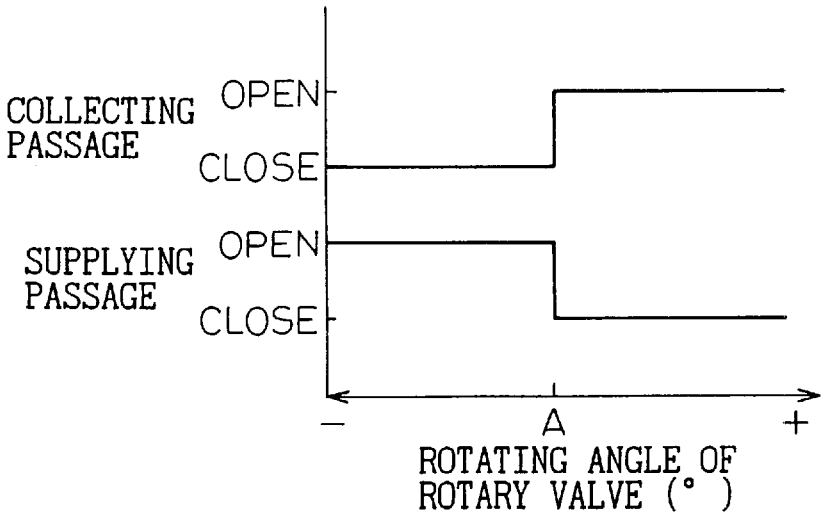
FIG. 9 is a timing chart showing a relationship between the operation of opening and closing the collecting passage and the supplying passage, and the rotating angle of the rotary valve of the viscous fluid type heat generator of FIG. 5.

In this case, when the temperature of silicon oil in the control chamber CR is low, the heating capacity is too low. Accordingly, as shown in FIG. 7, the bimetal spiral spring 23 rotates the rotary valve 24 to the left in the drawing via the valve shaft 22. At this time, the first collecting hole 3*c* is not communicated with the second collecting hole 24*a*, and the first supplying hole 3*e* is communicated with the second supplying hole 24*b*. That is, as indicated by the rotational angle A (degree) shown in FIG. 9, which is a schematic graph, the collecting passage 3*b* is closed in the control chamber CR, and at the same time, the supplying passage 3*d* is opened to the control chamber CR. Therefore, silicon oil in the heating chamber 8 is not collected into the control chamber CR via the collecting recess 3*b*, the first collecting hole 3*c* and the second collecting hole 24*a*. Silicon oil collected in the control chamber CR is supplied into the heating chamber 8 via the second supplying hole 24*b*, the first supplying hole 3*e* and the supplying groove 3*d*. At this time, as shown in FIG. 5, silicon oil in the control chamber CR can be easily sent out between the front wall surface of the heating chamber 8 and the front end surface 15*a* of the rotor 15 via the inner circumferential circular holes 20. When silicon oil is supplied into the liquid-tight clearances between the wall surfaces of the heating chamber 8 and the outer surfaces of the rotor 15, inevitably existing air is pushed by silicon oil and moved from the upper portion of the heating chamber 8 to the control chamber CR via the gas groove 3*f* and the gas hole 3*g*. Therefore, no gas exists in the liquid-tight clearances between the wall surfaces of the heating chamber 8 and the outer surfaces of the rotor 15. Therefore, a quantity of heat generated in the liquid-tight clearances between the wall surfaces of the heating chamber 8 and the outer surfaces of the rotor 15 is increased, that is, the heating capacity is enhanced, and the intensity of heating can be increased.

On the other hand, when the temperature of silicon oil in the control chamber CR is raised, the intensity of heating is too high. Accordingly, as shown in FIG. 8, the bimetal spiral spring 23 somewhat rotates the rotary valve 24 to the right in the drawing via the valve shaft 22. Due to the foregoing, the first collecting hole 3*c* is communicated with the second collecting hole 24*a*, and at the same time the first supplying hole 3*e* is not communicated with the second supplying hole 24*b*. That is, as shown by the rotational angle +A (degree) in FIG. 9, the collecting hole 3*b* is open to the control chamber CR, and at the same time the supplying passage 3*d* is closed in the control chamber CR. Therefore, silicon oil is collected from the heating chamber 8 into the control chamber CR via the collecting recess 3*b*, the first collecting hole 3*c* and the second collecting hole 24*a*. At this time, as shown in FIG. 5, silicon oil between the front wall surface of the heating chamber 8 and the front end surface 15*a* of the rotor 15 is easily collected into the control-chamber CR via the inner circumferential circular holes 20. Silicon oil collected into the control chamber CR is not supplied into the heating chamber 8 via the second supplying hole 24*b*, the first supplying hole 3*e* and the supplying groove 3*d*. When silicon oil is collected into the control chamber CR, inevitably existing air is pushed by silicon oil and moved from an upper portion of the control chamber CR into the heating chamber 8 via the gas groove 3*f* and gas hole 3*g*. Therefore, bubbles exist in the liquid-tight clearances between the wall surfaces of the heating chamber 8 and the outer surfaces of the rotor 15. For this reason, the quantity of heat generated in the liquid-tight clearances between the wall surfaces of the heating chamber 8 and the outer surfaces of the rotor 15 is decreased, that is, the heating capacity is reduced, and an intensity of heating is decreased.

Therefore, in this viscous fluid type heat generator, the structure is simple, and the heating capacity can be reliably decreased and increased by changing the characteristics in the viscous fluid type heat generator. Accordingly, the electromagnetic clutch is not necessarily required when the heater is turned on and off. Further, when the capacity is changed, it is not necessary to input power from the outside. Therefore, it is possible to reduce the manufacturing cost of the heater and also it is possible to reduce the weight of the heater.

In this viscous fluid type heat generator, when silicon oil is collected from the heating chamber 8 into the control chamber CR, or on the contrary, when silicon oil is supplied from the control chamber CR into the heating chamber 8, the tightly closed total volume of the heating chamber 8, the collecting passage 3*b*, the supplying passage 3*d* and control chamber CR is not changed. Therefore, when silicon is moved, no negative pressure is generated. Due to the foregoing, no silicon oil comes into contact with fresh air, and no moisture is drawn from the atmosphere into the silicon oil at any time. Accordingly, no deterioration is caused in the silicon oil. Consequently, even after this viscous fluid type heat generator has been used over a long period of time, the heating efficiency is not lowered.

Further, in this viscous fluid type heat generator, a single rotary valve 24 is adopted for synchronous control. Accordingly, this viscous fluid type heat generator is advantageous in that the number of parts can be decreased.

The shaft of this viscous fluid type heat generator is short. Accordingly, this viscous fluid type heat generator can be easily incorporated into a vehicle.

Further, in this viscous fluid type heat generator, in the outer circumferential region of the rotor 15, there are provided outer circumferential circular holes 19 and inclined recesses 21 and further, in the inner circumferential region, there are provided inner circumferential circular holes 20. Accordingly, this viscous fluid type heat generator can provide the same effects as those described in the first embodiment by the outer circumferential circular holes 19, the inner circumferential circular holes 20 and the inclined recesses 21. That is, in this viscous fluid type heat generator, the outer circumferential circular holes 19 provide the following effects. The binding action of viscous fluid is facilitated; an intensity of the shearing force of viscous fluid is increased when gas contained in viscous fluid is collected into the outer circumferential circular holes 19; and oil-scraping effect is high, so that the operation of the viscous fluid type heat generator can start quickly. In this viscous fluid type heat generator, the inclined recesses 21 provide the following effects. While the rotor 15 is prevented from inclining with respect to the axis of the drive shaft 14, the rotor 15 can be reliably held in the heating chamber 8 at a substantially neutral position in the axial direction. Further, by the existence of the outer circumferential circular holes 19, the inner circumferential circular holes 20 and the inclined recesses 21, the fluidity of viscous fluid at the front and rear of the rotor 15 is enhanced. Accordingly, a reduction in a quantity of generated heat caused by uneven distribution of viscous fluid can be effectively avoided.

In this connection, in this viscous fluid type heat generator, the control chamber CR is provided, so when operation of the viscous fluid type heat generator is stopped, a large quantity of gas exists in an upper portion of the heating chamber 8. Accordingly, compared with a viscous fluid type heat generator in which no control chamber CR is provided, oil-scraping effect is enhanced by the cutout portion 21 provided on the outer circumferential side of the rotor 15.

In this viscous fluid type heat generator, a cross-sectional area between the rear end surface 15*b* of the rotor 15 and the rear wall surface of the heating chamber 8 is smoothly changed by the existence of the inclined recesses 21. When the cross-sectional area of the passage of viscous fluid is smoothly changed as described above, viscous fluid can easily flow from control chamber CR into the heating chamber 8. Therefore, when the heating capacity is increased, viscous fluid is quickly fed from the control chamber CR into the heating chamber 8, so that the heating capacity can be quickly increased.

Further, in this viscous fluid type heat generator, even when a quantity of viscous fluid in the heating chamber 8 is too small and the rotor 15 is rotated at a low speed, viscous fluid accommodated in a lower portion of the heating chamber 8 can be quickly spread to the entire heating region by the oil-scraping effect provided by the outer circumferential circular holes 19 arranged in the outer circumferential region of the rotor 15. Accordingly, the condition of the viscous fluid type heat generator in which the heating capacity is decreased can be quickly returned to the condition of the viscous fluid type heat generator in which the heating capacity is increased.

In the above described first and second embodiments, the viscous fluid type heat generator is provided with an auxiliary oil chamber such as the storage chamber SR or the control chamber CR. However, it should be noted that the present invention is not limited to the above specific embodiments. Of course, the present invention can be applied to a viscous fluid type heat generator having no auxiliary oil chamber.

In the above described first and second embodiments, the electromagnetic clutch may be used for driving the drive shaft 14 intermittently instead of the pulley.

In the above described first and second embodiments, the outer circumferential circular holes 19 and the inner circumferential circular holes 20 are adopted as through-holes. Of course, the shape of the through-holes is not limited to a circle, and further the through-holes need not be provided.

It is possible to contemplate the following features within the disclosure.

(a) A viscous fluid type heat generator comprising: a housing having formed therein a heating chamber and a heat radiating chamber arranged adjacent to the heating chamber for circulating a circulating fluid; a drive shaft rotatably supported by the housing via a bearing unit; a rotor capable of rotating in the heating chamber and driven by the drive shaft; a liquid-tight clearance being formed between the rotor and a wall surface of the heating chamber; and a viscous fluid contained in the heating chamber, interposed in the liquid-tight clearance, heated by the rotation of the rotor. The housing includes a storage chamber communicated with the heating chamber via a collecting passage and a supplying passage, the storage chamber is capable of accommodating a volume of viscous fluid exceeding the viscous fluid accommodating volume of the heating chamber, and at least one of the front and the rear end surface of the rotor includes an inclined recess arranged in the circumferential direction and formed in such a manner that the bottom of the inclined recess gradually becomes shallow in the opposite direction to the rotational direction of the rotor.

(b) A viscous fluid type heat generator comprising: a housing having a heating chamber and a heat radiating chamber arranged adjacent to the heating chamber for circulating a circulating fluid; a drive shaft rotatably supported by the housing via a bearing unit; a rotor capable of rotating in the heating chamber and driven by the drive shaft; a liquid-tight clearance being formed between the rotor and a wall surface of the heating chamber; and a viscous fluid contained in the heating chamber, interposed in the liquid-tight clearance, heated by the rotation of the rotor. The housing includes a collecting passage communicated with the heating chamber, a supplying passage communicated with the heating chamber, and a control chamber communicated with the collecting and supplying passages, at least one of the collecting and supplying passages can be opened and closed, viscous fluid is collected from the heating chamber into the control chamber via the collecting passage so as to decrease the heating capacity, viscous fluid is fed from the control chamber into the heating chamber via the supplying passage so as to increase the heating capacity, and at least one of the front and rear end surfaces of the rotor includes inclined recesses arranged in the circumferential direction and formed in such a manner that the bottoms of the inclined recess gradually becomes shallower in the direction opposite to the rotational direction of the rotor.

In the viscous fluid type heat generator described in item (a) or (b), it is not an indispensable condition that the rotor is connected with the drive shaft in such a manner that the rotor can axially move. It is possible that the rotor is fixed to the drive shaft by means of press-fitting.

(c) A viscous fluid type heat generator according to the above item (a) or (b), wherein the rotor has through-holes penetrating the rotor in the axial direction, the through-holes are formed so that the liquid-tight clearance can be enlarged in accordance with the rotation of the rotor, and the inclined recesses are formed in at least one of the front end surface and the rear end surface of the rotor by chamferring edge portions of the through-holes on the trailing side in view of the rotational direction of the rotor.

(d) A viscous fluid type heat generator described in item (c), wherein the through-holes are formed in the outer circumferential region of the front end surface and the rear end surface of the rotor.

(e) A viscous fluid type heat generator described in item (c) or (d), wherein the through-holes have right angled edges.

The viscous fluid type heat generator described in item (a) or (b), wherein the technical task to be solved is to enhance the fluidity of viscous fluid flowing from the auxiliary oil chamber into the heating chamber in the viscous fluid type heat generator, the housing of which includes an auxiliary oil chamber such as a storage chamber or a control chamber.

In the case where viscous fluid flows from the auxiliary oil chamber into the heating chamber via the supplying hole, when there is a large difference between the cross-sectional area of the supplying hole and the cross-sectional area of the clearance formed between the rear end surface of the rotor and the rear wall surface of the heating chamber, the fluidity of viscous fluid is lowered because of a sudden change in the cross-sectional area of the passage. As a result, the circulating property of the viscous fluid is lowered, and further the viscous fluid is deteriorated. In the viscous fluid type heat generator having a control chamber, the capacity of which can be changed, supply of the viscous fluid to the heating chamber is delayed in the case of extending the heating capacity, and it is impossible to quickly increase a quantity of generated heat.

On the other hand, in the viscous fluid type heat generator described in item (a) or (b), at least one of the front and rear end surfaces of the rotor includes inclined recesses which extend in the circumferential direction and the bottom portion of which gradually becomes shallower in the direction opposite to the rotational direction of the rotor. Accordingly, the cross-sectional area formed between at least one of the front and rear end surfaces of the rotor, and at least one of the front and rear wall surfaces of the opposing heating chamber, is smoothly changed by the inclined recess. When the cross-sectional area of the passage of viscous fluid is smoothly changed as described above, viscous fluid easily flows from the auxiliary oil chamber into the heating chamber via the supplying passage.

Accordingly, the circulating property of viscous fluid between the heating chamber and the auxiliary oil chamber can be enhanced, and deterioration of viscous fluid can be delayed. In the viscous fluid type heat generator described in item (b), the heating capacity of which can be changed, when the heating capacity is extended, it is possible to quickly feed viscous fluid from the control chamber into the heating chamber. Accordingly, it is possible to quickly increase a quantity of heat generated in viscous fluid.

In this connection, when the inclined recesses are provided only on the front end surface of the rotor, on the rear wall surface of the heating chamber, that is, on the front wall surface 3*a* of the rear plate 3, the supplying groove (3*m* or 3*d*) is provided which extends from the supplying hole (3*k* or 3*e*) to the outer region of the heating chamber, as shown in the first and second embodiments, and viscous fluid is sent from the supplying hole to the outer region of the heating chamber via the supplying groove, and viscous fluid is fed to the front side of the rotor via the clearance between the outer circumferential side of the rotor and the inner circumferential side of the heating chamber.

We claim:

1. A viscous fluid type heat generator comprising:

a housing having therein a heating chamber and a heat radiating chamber arranged adjacent to the heating chamber for circulating a circulating fluid through said heat radiating chamber, said heating chamber having opposite wall surfaces;

a drive shaft rotatably supported by the housing;

a rotor rotatably arranged in the heating chamber and driven by the drive shaft, said rotor having front and rear end surfaces, liquid-tight clearances being formed between the front and rear end surfaces of the rotor and the wall surfaces of the heating chamber, respectively;

a viscous fluid contained in the heating chamber, said viscous fluid existing in the liquid-tight clearances so as to be heated during the rotation of the rotor; and wherein the rotor is fitted on the drive shaft in such a manner that the rotor cannot rotate relative to the drive shaft but can move axially relative to the drive shaft, and the front and rear end surfaces of the rotor have wedge effect producing means, respectively, for correcting an axial offset of the rotor in the heating chamber by a wedge effect caused via the pressure of the viscous fluid during the rotation of the rotor.

2. A viscous fluid type heat generator according to claim 1, wherein said wedge effect producing means comprises at least three inclined recesses extending circumferentially in the rotor and having bottoms formed gradually shallower in the direction opposite to the rotational direction of the rotor, the inclined recesses being arranged at circumferentially constant intervals, and at radially equal positions from the center of the rotor.

3. A viscous fluid type heat generator according to claim 2, wherein the rotor has through-holes axially penetrating the rotor, so that the liquid-tight clearance can be changed to enlarge the latter during the rotation of the rotor, and each inclined recess is formed in each of the front end surface and the rear end surface of the rotor by chamferring an edge portion of the through-hole on the trailing side thereof in view of the rotational direction of the rotor.

4. A viscous fluid type heat generator according to claim 3, wherein the through-holes are formed in a relatively outer circumferential region of the front end surface and the rear end surface of the rotor.

5. A viscous fluid type heat generator according to claim 3, wherein the through-holes have right angled edges.

6. A viscous fluid type heat generator according to claim 1, wherein the housing has a storage chamber to communicate with the heating chamber via a collecting passage and a supplying passage to accommodate a volume of viscous fluid exceeding the volume of the viscous fluid accommodated in the heating chamber.

7. A viscous fluid type heat generator according to claim 1, wherein the housing includes a collecting passage communicated with the heating chamber, a supplying passage communicated with the heating chamber, and a control chamber communicated with the collecting passage and the supplying passage, at least one of the collecting passage and the supplying passage being capable of being opened and closed, the viscous fluid being collected from the heating chamber into the control chamber via the collecting passage so as to decrease the heating capacity, the viscous fluid being supplied from the control chamber into the heating chamber via the supplying passage so as to increase the heating capacity.

* * * * *